US005609257A

United States Patent [19]

Feinbloom

[11] Patent Number: 5,609,257

[45] Date of Patent: Mar. 11, 1997

[54] STORAGE RACK FOR OPTICAL PRISMS

[75] Inventor: Richard E. Feinbloom, New York, N.Y.

[73] Assignee: Designs for Vision, Inc., Ronkonkoma, N.Y.

[21] Appl. No.: 437,406

[22] Filed: May 12, 1995

Related U.S. Application Data

[63] Continuation-in-part of Ser. No. 349,044, Dec. 2, 1994, Pat. No. 5,584,400.

[51] Int. Cl.[6] ..... A47F 7/00

[52] U.S. Cl. ..... 211/13; 211/41

[58] Field of Search ..... 211/13, 184, 174, 211/40, 41

[56] References Cited

U.S. PATENT DOCUMENTS 2,121,225 6/1938 Ghrist ..... 211/41 X 4,969,560 11/1990 Stanfield ..... 211/41

5,332,105 7/1994 Stanfield ..... 211/41

*Primary Examiner*—Alvin C. Chin-Shue

*Assistant Examiner*—Sarah L. Purol

*Attorney, Agent, or Firm*—Plevy & Associates

[57] ABSTRACT

A rack for simultaneously storing prisms having varying sizes and shapes, comprising a plurality of clamps for holding the prisms. Each clamp includes a fixed clamping block and an oppositely disposed movable clamping block for enabling the clamp to self-adjust to the size and shape of a prism to be held therein. The clamps are mounted in a frame which includes a clamp supporting cross-member for mounting the clamps to the frame.

20 Claims, 5 Drawing Sheets

STORAGE RACK FOR OPTICAL PRISMS

This is a continuation-in-part of Ser. No. 08/349,044, filed Dec. 2, 1994, entitled "Adustable Lens Rack" now Pat. No. 5,584,400.

FIELD OF INVENTION

This invention relates generally to storage racks and more particularly, to a storage rack for differently sized and shaped optical prisms.

BACKGROUND OF THE INVENTION

As is well known, prisms are generally solid blocks of glass or other transparent materials cut to precise shapes and sizes for optical purposes. Since prisms are used for a variety of optical applications, a prism manufacturer will often concurrently produce prisms of various shapes and sizes for different products.

In the manufacture of prisms for binoculars and other products, storage racks are necessary for compact storage of the prisms prior to their final assembly in the product. A large number of prisms may be stored in racks for simultaneous cleaning via ultrasound or with cleaning solvents. An "open" type rack is employed for this purpose, whereupon the prisms are air dried prior to the next assembly step.

Prior art racks are generally designed for storing a prism of a given size and shape. As a result, a number of differently sized racks are necessary to store prisms of different sizes and shapes. The manufacturing and storing all these different racks ultimately consumes a considerable amount of machinist time and money.

Copending U.S. patent application, Ser. No. 08/349,044 entitled "ADJUSTABLE LENS RACK", to Richard E. Feinbloom and assigned to the assignee herein, discloses an adjustable, open-type lens rack. This lens rack employs a pair of lens retaining bars that are movably adjustable with respect to one another. Each retaining bar includes a plurality of channels wherein the lenses are retained. Generally, this rack designates each row for a given lens thickness, since the fixed channels of each retaining bar are designed to accept a lens of a given thickness. This rack, however, is not especially suited for holding prisms which are often concurrently produced in a multitude of various shapes and sizes.

Accordingly, it is an object of the present invention to provide a rack that is especially suited for simultaneously storing prisms of diverse sizes and shapes.

SUMMARY OF THE INVENTION

A rack for simultaneously storing prisms having varying sizes and shapes, comprising clamping means for holding the prisms. The clamping means includes at least one fixed clamping block and at least one movable clamping block for enabling the clamping means to self-adjust to the size and shape of a prisms to be held therein. The rack further includes frame means for mounting the clamping means.

BRIEF DESCRIPTION OF THE DRAWINGS

The novel features of the present invention will become apparent from the following detailed description of the invention illustrated in the accompanying drawings, wherein.

DETAILED DESCRIPTION OF THE INVENTION

Figure 1:
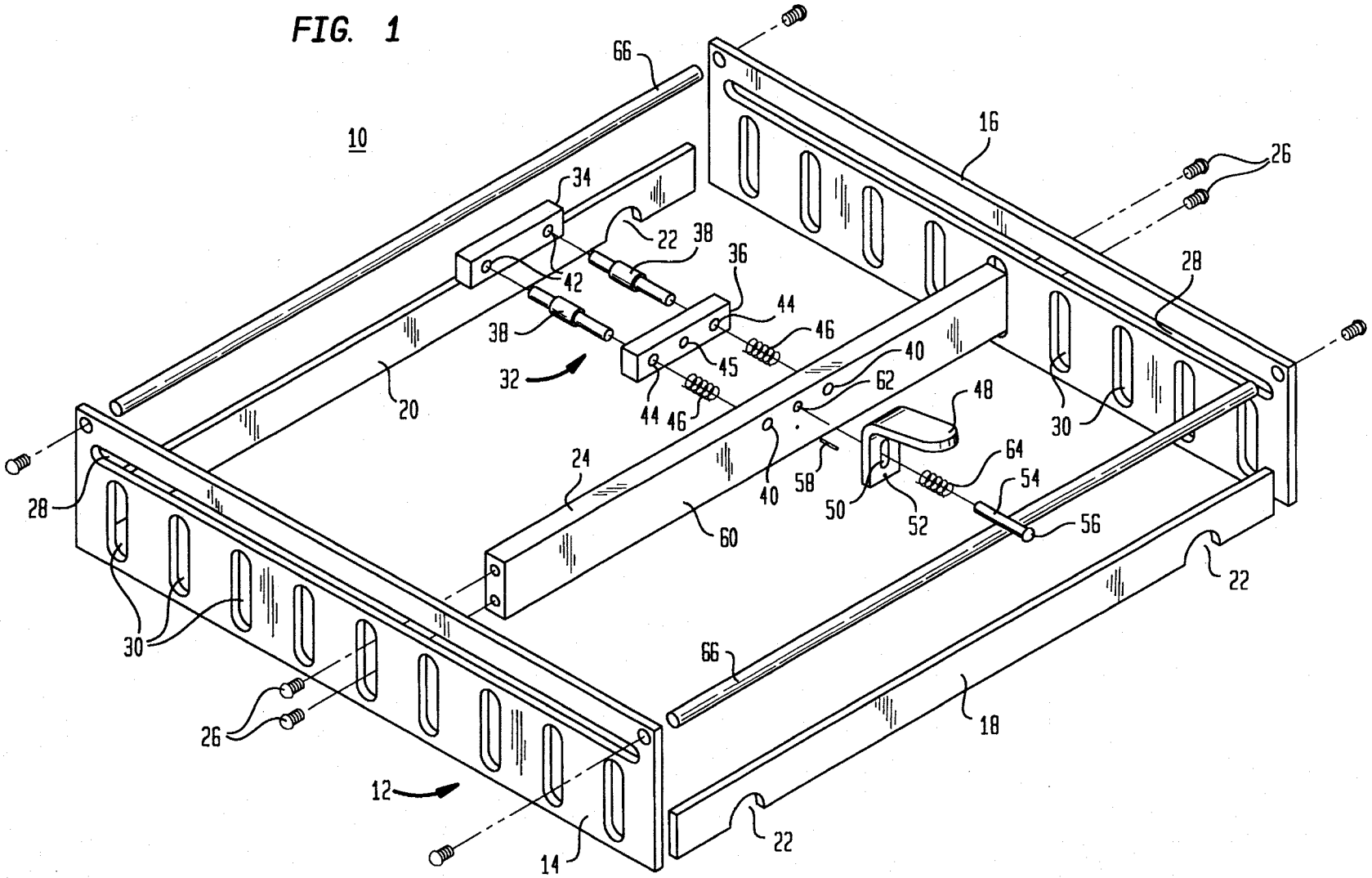
FIG. 1 is an exploded view of an exemplary embodiment of the present invention.

Referring to FIG. 1, there is an exploded view of an exemplary embodiment of the novel prism rack of the present invention designated by the numeral 10. The prism rack 10 generally comprises 3 basic components which include a frame 12, at least one clamp supporting cross-member 24 held within the frame 12, and one or more automatically adjusting prism clamps 32 attached to the clamp supporting cross-member.

The prism rack 10 comprises a generally rectangular frame 12 which includes a first side member 14, a second side member 16, a first end member 18, and second end member 20. The first and second end members 18 and 20 are welded to the lower portions of the first and second side members 14 and 16, although any other suitable manner of attachment is contemplated.

Each end member 14 and 16 includes a pair of spaced apart semicircular cut-outs 22 which enable the prism rack 10 to be mounted on a large rack carrier (not shown). Thus, several prism racks can be mounted on the carrier rack for bulk cleaning operations.

The clamp supporting cross-member 24 extends between the first and second side members and is removably connected thereto by screw fasteners 26 or any other like means. A single horizontally running slot 28 and a plurality of vertical slots 30 are defined in each side member to allow one or more clamp supporting cross-members to be selectively placed within the frame 12 in a variety of locations as desired.

One or more prism clamps 32 (only one shown for clarity), are mounted on the clamp supporting cross-member. Each prism clamp 32 is designed to hold a single prism. Moreover, the prism clamp 32 is capable of adapting to the size and shape of the prism to be held therein.

Figure 2:
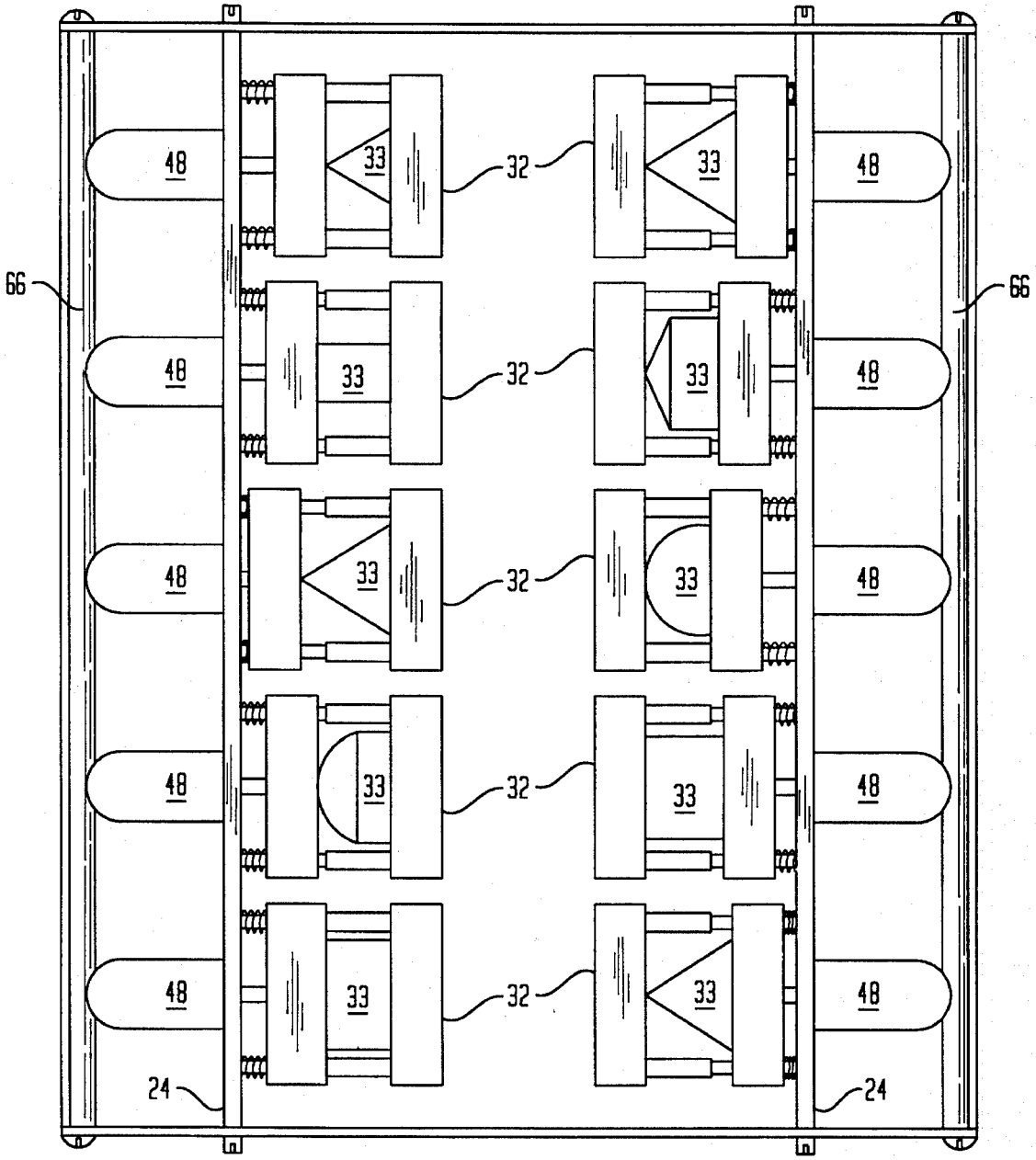
FIG. 2 is a top plan view of a preferred exemplary embodiment of the present invention.

As shown in FIG. 2, the rack 10 of the present invention preferably includes two clamp supporting cross-members 24, each of which supports five prism clamps 32 in a side by side arrangement. The rack shown in FIG. 2 is shown fully loaded with differently sized and shaped prisms 33. As can be seen, each prism clamp 32 is capable of automatically adjusting to the individual prism 33 held therein.

Figure 3:
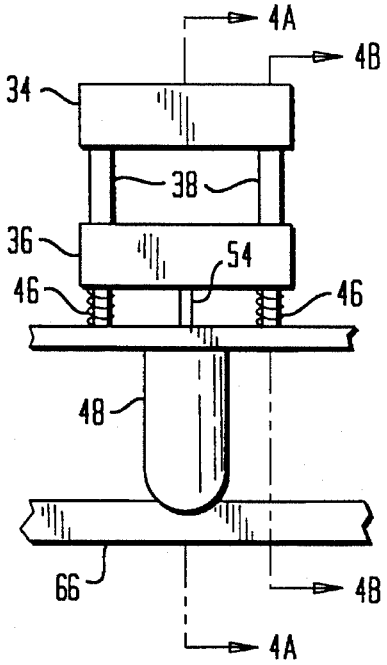
FIG. 3 is a top plan view of an exemplary embodiment of one of the clamps.

Referring again to FIG. 1 and, also to FIG. 3, each prism clamp includes a fixed clamping block 34 and an oppositely disposed movable spring-biased clamping block 36 for enabling the clamp to self-adjust to the size and shape of the prism to be held therein. The clamp further includes a pair of spaced apart pins 38, which extend from the clamp supporting cross-member 24. The pins 38 are non-removably received in apertures 40 defined in the clamp supporting cross-member 24. The fixed clamping block 34 includes a pair of apertures 42 that non-removably receive the free ends of the pins 38 in order to rigidly attach the fixed clamping block 34 to the clamp supporting cross-member 24. The movable clamping block 36 includes two outer apertures 44 and a central aperture 45. The two outer apertures 44 are sized so that the movable clamping block 36 can slidably move along the pins 38, variably changing the distance between the two clamping blocks in order to enable the clamping assembly 32 to accommodate to the size and shape of the prism to be held therein. A clamping block return spring 46 is coaxially located around each pin 38 between the movable clamping block 36 and the clamp supporting cross-member 24. The return springs 46 bias the movable clamping block 36 toward the fixed clamping block 34.

Figure 4A:
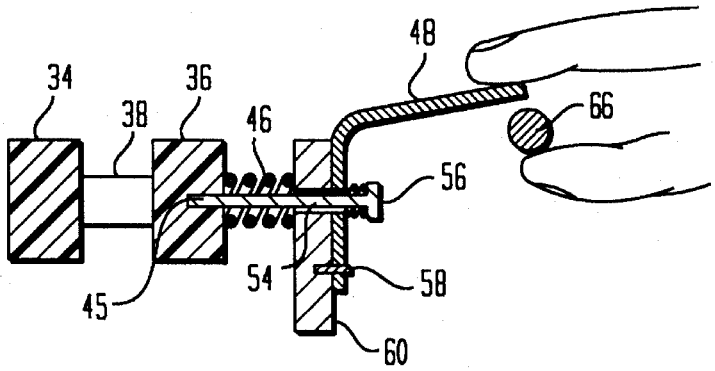
FIG. 4A is a cross-sectional side view through line 4A—4A in FIG. 3.
Figure 4B:
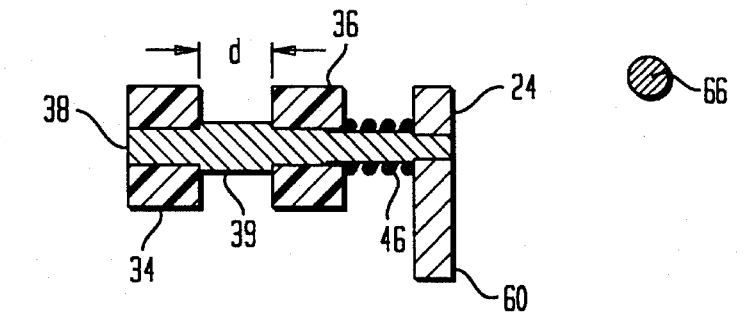
FIG. 4B is a cross-sectional side view through line 4B—4B in FIG. 3.

In the cross sectional view shown in FIG. 4B, one can see that the each pin 38 includes an increased diameter portion 39. The increased diameter portion 39 acts as a spacer to maintain a minimum predetermined distance d between the fixed and movable clamping blocks. This minimizes the clamp opening distance which is desirable when the prisms are fairly close in size and shape and the prism loading time needs to be minimized. However, if desirable, the increased diameter portion 39 of the pins 38 can be eliminated to allow the movable clamping block to make contact with the fixed clamping block when a prism is not inserted therein.

Referring again to FIGS. 1 and 3 and also to FIG. 4A, the clamp 32 also includes an angled lever 48 having an upper elongated aperture 50 and a lower circular aperture 52. The angled lever 48 is pivotally attached to the clamp supporting cross-member 24 by a linkage rod 54 having an enlarged head portion 56. A locating pin 58, which extends from the lever surface 60 of the clamp supporting cross-member 24 and is received by the circular aperture 52 of the angled lever, prevents the angled lever 48 from rotating on the linkage rod 54. The linkage rod 54 extends through the elongated aperture 50 in the angled lever 48 and an aperture 62 defined in the clamp supporting cross-member 24, where it is non-removably received by the center aperture 45 defined in the movable clamping block 36. An anti-rattle spring 64 is disposed between the enlarged head portion 56 and the angled lever 48 to prevent the angled lever 48 from disengaging from the lever locating pin 58.

A finger bar 66 extends between the upper portions of the first and second side members 14 and 16 at each end of the frame 12 and is oriented just below the angled levers as shown in FIG. 4A. The finger bar 66 aids the user in applying an actuating force to a lever. The user simply squeezes the angled lever 48 and the finger bar 66 with the fingers of the hand. The squeezing pressure causes the angled lever 48 to move down toward the finger bar 66. As the lever 48 moves down, it engages the enlarged head 56 of the linkage rod 54 and pulls it and the coupled movable clamping block 36 away from the fixed clamping block 34 so that a prism can be inserted in the clamp 32. When the lever 48 is released, the clamp block return springs 46 acting between the clamp support cross-member 24 and the movable clamping block 36 automatically adjust the distance between the clamping blocks to hold the prism therebetween. This arrangement enables the clamps 32 to self-adjust to the size and shape of the prism to be held therein.

The support frame 12 including the clamp supporting cross-members 24 and the angled levers 48 of the clamps 32 are preferably made from a metal such as stainless steel or aluminum, however, any other suitable material can be used. The clamping blocks 34 and 36 are preferably made from plastic or any other suitable material that will not scratch or damage the prisms.

Although the present invention is especially suited for storing optical prisms, it can also be used or easily adapted to store other like items such as optical lenses. Further, the rack of the present invention can also be used or easily adapted to store other small items if desired.

Figure 5A:
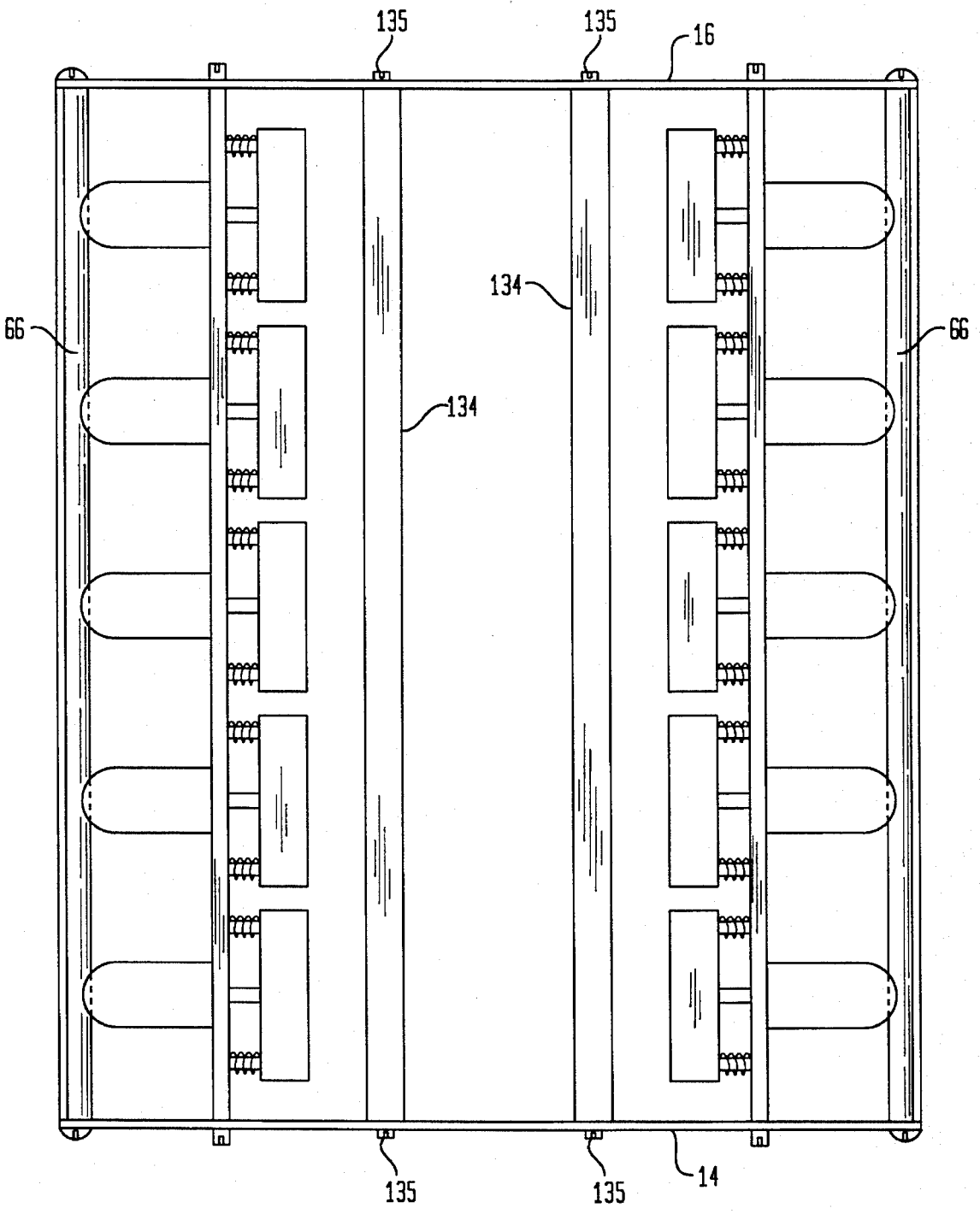
FIG. 5A is a top plan view of an alternative embodiment of the invention and FIG. 5B is a top plan view of another alternative embodiment of the invention.
Figure 5B:
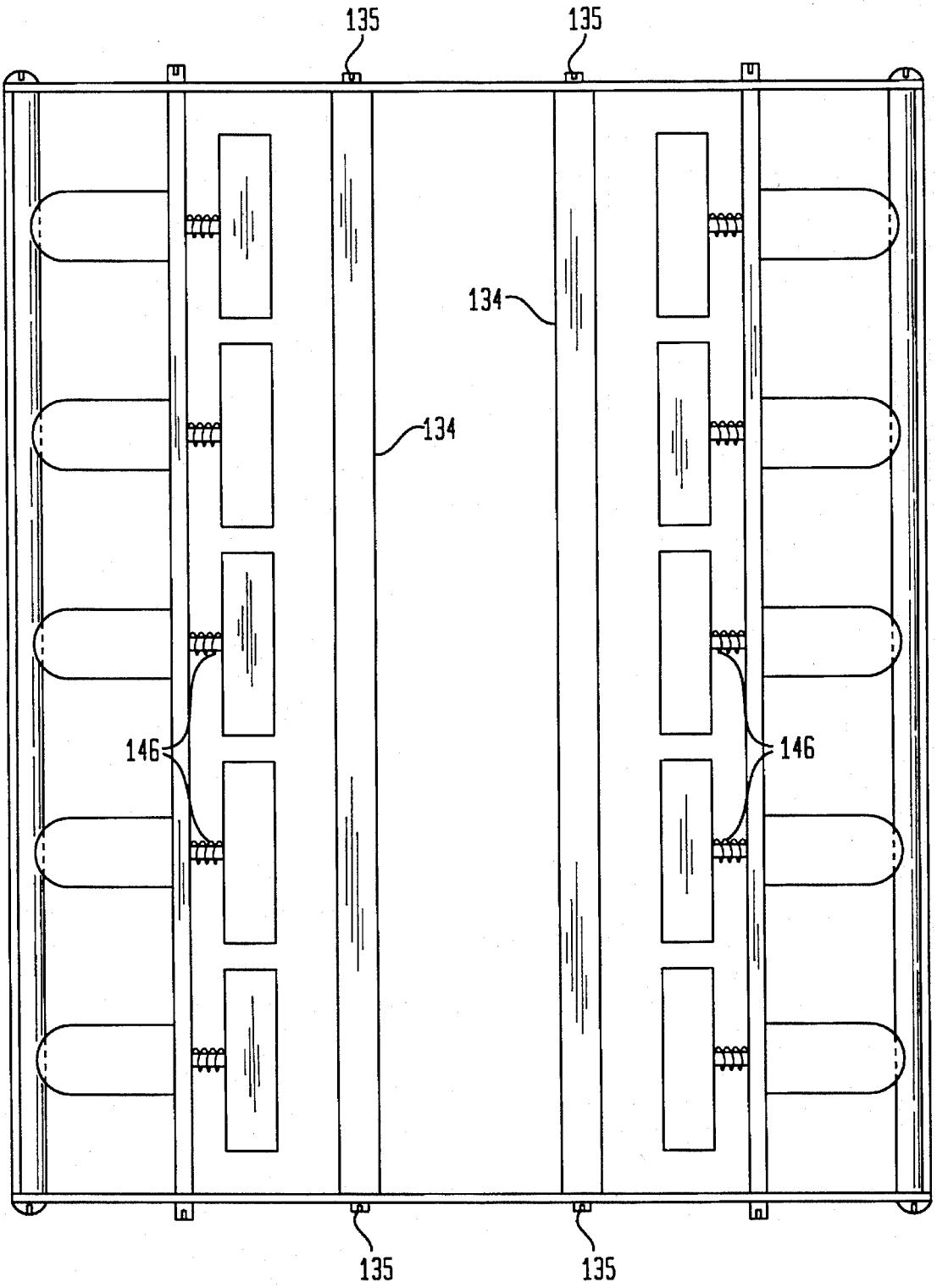

It should be understood that the embodiments described herein are merely exemplary and that a person skilled in the art may make many variations and modifications to these embodiments utilizing functionally equivalent elements to those described herein. For example, in the embodiment shown in FIG. 5A, the fixed clamping block is configured as a single fixed block 134 that extends continuously between the first and second side members 14 and 16. In this embodiment, the fixed block 134 is secured directly at its ends in the horizontal slot of the side members with fasteners 135 thereby eliminating the need to be secured by the pins as in the previous embodiment. The embodiment shown in FIG. 5B is similar to the embodiment shown in 5A except that the pins have been eliminated altogether and a single movable clamping block return spring 146 is coaxially provided around the linkage rod 54.

In any case, all such variations or modifications as well as others which may become apparent to those skilled in the art, are intended to be included within the scope of the invention as defined by the appended claims.

I claim:

1. A rack for simultaneously storing prisms having varying sizes and shapes, comprising:

clamping means for holding prisms, said clamping means including at least one fixed clamping block and a plurality of movable clamping blocks, each movable clamping block being oppositely disposed to said at least one fixed clamping block for enabling said clamping means to self-adjust to the size and shape of a prism to be held therein; and frame means for mounting said clamping means.

2. The rack according to claim 1, wherein said frame means includes means for mounting said clamping means to said frame means.

3. The rack according to claim 2, wherein said clamping means includes a pair of spaced apart pins for rigidly attaching said at least one fixed clamping block to said mounting means.

4. The rack according to claim 2, wherein said clamping means further includes lever means coupled to at least one of said plurality of movable clamping blocks for allowing manual manipulation of said clamping means.

5. The rack according to claim 3, wherein said lever means is pivotally attached to said mounting means and said mounting means is orientated between at least one of said plurality of movable clamping blocks.

6. The rack according to claim 2, wherein said clamping means further includes spring bias means for biasing at least one of said plurality of movable clamping blocks toward said at least one fixed clamping block.

7. The rack according to claim 5, wherein said spring bias means is orientated between said mounting means and at least one of said plurality of movable clamping blocks.

8. The rack according to claim 1, wherein said at least one fixed clamping block comprises a plurality of separate fixed clamping blocks.

9. The rack according to claim 1, wherein said clamping means further includes lever means coupled to at least one of said movable clamping blocks for allowing manual manipulation of said clamping means, and said frame means further includes a finger bar means for gripping said lever means to manually manipulate said clamping means.

10. A rack for simultaneously storing prisms having varying sizes and shapes, comprising:

at least one spring-biased clamp for holding the prisms, said at least one clamp including a fixed clamping block and an oppositely disposed movable clamping block for enabling said at least one spring-biased clamp to self-adjust to the size and shape of a prism to be held therein; and a frame for mounting said at least one clamp, said frame having a clamp supporting cross-member for mounting said at least one clamp to said frame.

11. The rack according to claim 10, wherein said at least one clamp further includes a pair of spaced apart pins for rigidly attaching said fixed clamping block to said clamp supporting cross-member.

12. The rack according to claim 10, wherein said at least one clamp further includes an angled lever pivotally attached to said clamp supporting cross-member, said angled lever being coupled to said movable clamping block for allowing manual manipulation of said clamp.

13. The rack according to claim 12, wherein said at least one clamp further includes a linkage rod which passes through an aperture defined in said clamp supporting cross-member to couple said angled lever to said movable clamping block.

14. The rack according to claim 10, wherein said at least one clamp further includes spring bias means for biasing said movable clamping block toward said fixed clamping block, said spring bias means being oriented between said clamp supporting cross-member and said movable clamping block.

15. The rack according to claim 13, wherein said at least one clamp further includes an angled lever pivotally attached to said clamp supporting cross-member, said angled lever being coupled to said movable clamping block to said clamp supporting cross-member, and said frame further includes a finger bar for gripping said lever to manually manipulate said at least one clamp.

16. The rack according to claim 10, wherein said at least one clamp comprises a plurality of clamps.

17. A rack for simultaneously storing a plurality of prisms having varying sizes and shapes, comprising:

a plurality of clamps, each of said clamps for holding one of the prisms, wherein each of said clamps includes a fixed clamping block and an oppositely disposed movable spring-biased clamping block for enabling said clamp to self-adjust to the size and shape of a prism to be held therein; and a frame having at least one clamp supporting cross-member for mounting said clamps side by side in a row within said frame.

18. The rack according to claim 17, wherein each of said clamps further includes a pair of spaced apart pins, which extend from said at least one clamp supporting cross-member, said fixed clamping block being rigidly attached to a free end of each of said pins and said movable clamping block being slidably movable along said pins.

19. The rack according to claim 17, wherein each of said clamps further includes an angled lever pivotally attached to said at least one clamp supporting cross-member said angled lever being coupled to said movable clamping block by a linkage rod which passes through an aperture defined in said at least one clamp supporting cross-member; and said frame further includes at least one finger bar oriented adjacent to said angled levers for allowing a user to apply an actuating force to a lever of a selected one of said clamps in order to move said movable clamping block of said selected clamp away from said fixed clamping block of said selected clamp when inserting a prism thereto.

20. The rack according to claim 1, wherein said clamping means includes one fixed clamping block and a plurality of movable clamping blocks oppositely disposed to and orientated across the fixed clamping block for enabling said clamping means to self-adjust to the size and shape of prisms to be held therein.

* * * * *